United States Patent [19]

Buller

[11] 3,952,543

[45] Apr. 27, 1976

[54] QUICK COOLING CRYOSTAT WITH VALVE UTILIZING SIMON COOLING AND JOULE THOMPSON EXPANSION

[75] Inventor: J. Stanley Buller, Santa Barbara, Calif.

[73] Assignee: Hughes Aircraft Company, Culver City, Calif.

[22] Filed: Dec. 13, 1974

[21] Appl. No.: 532,355

[52] U.S. Cl. ..... 62/514 JT; 137/74

[51] Int. Cl.[2] ..... F25B 19/00

[58] Field of Search ..... 137/13, 72, 73, 74; 62/217, 222, 223, 224, 514, 86

[56] References Cited

UNITED STATES PATENTS

| | | | |
|---|---|---|---|
| 2,991,633 | 7/1961 | Simon | 62/514 |
| 3,095,711 | 7/1963 | Wurtz, Jr. | 62/514 |
| 3,188,824 | 6/1965 | Geist et al. | 62/86 |
| 3,270,756 | 9/1966 | Dryden | 137/13 |
| 3,593,537 | 7/1971 | Stuart | 62/514 X |
| 3,714,796 | 2/1973 | Longsworth | 62/514 |
| 3,800,552 | 4/1974 | Sollami et al. | 62/514 X |

*Primary Examiner*—William O'Dea
*Assistant Examiner*—Ronald C. Capossela
*Attorney, Agent, or Firm*—Allen A. Dicke, Jr.; William H. MacAllister, Jr.

[57] ABSTRACT

A high pressure gas tank has its output closely connected to the input of a Joule Thomson cryostat. When the tank is permitted to discharge its gas, Simon cooling of the inlet gas to the cryostat decreases the time to cool down at the cold point in the cryostat.

9 Claims, 5 Drawing Figures

Fig. 1.
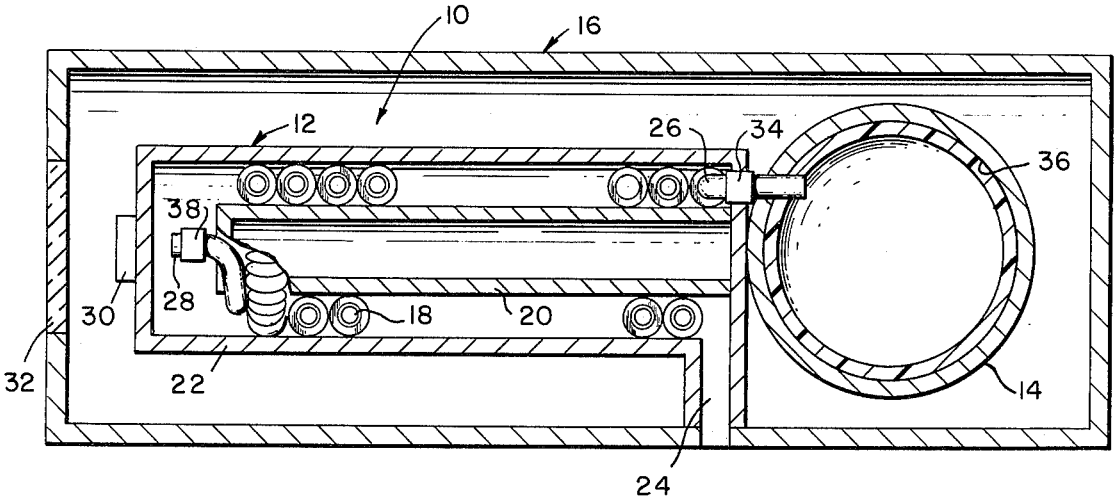
Fig. 2.
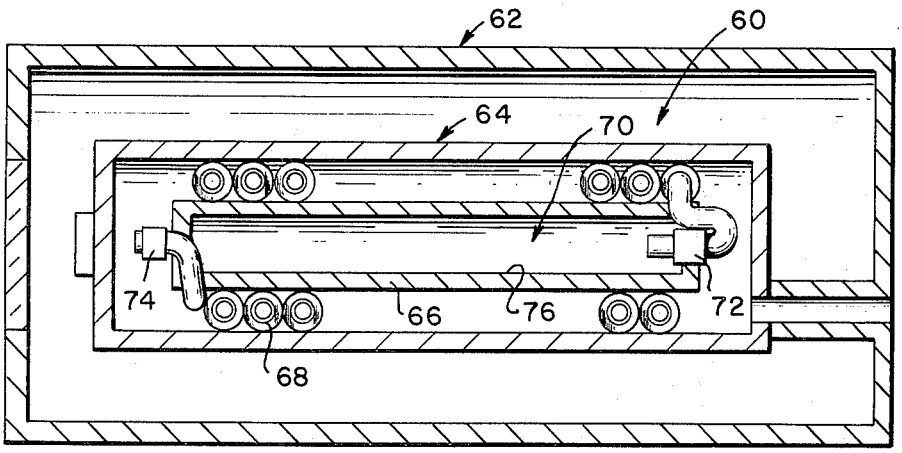
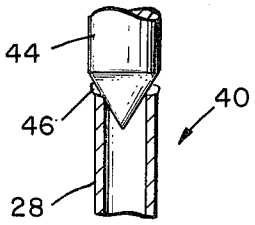
Fig. 3.
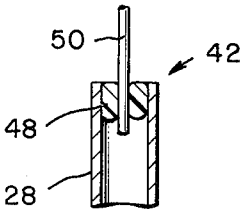
Fig. 4.
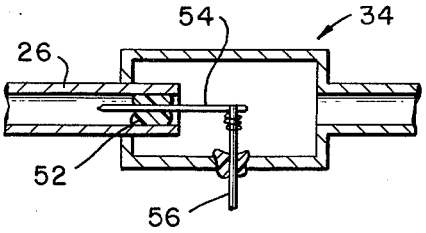
Fig. 5.

QUICK COOLING CRYOSTAT WITH VALVE UTILIZING SIMON COOLING AND JOULE THOMPSON EXPANSION

BACKGROUND

This invention is directed to a quick cooling cryostat which employs Simon cooling in cooperation with Joule Thomson cooling.

Simon cooling occurs in a high pressure gas tank when gas is discharged from the tank. The remaining gas in the tank does work on the gas being expelled, to decrease the temperature of the gas remaining in the tank. R. W. Stuart, U.S. Pat. No. 3,593,537 describes a Simon cooler.

A Joule Thomson cooler is one where a pre-cooled gas is expanded out of a nozzle at the cold point and the cold exhaust gas passes over the incoming higher pressure gas to provide the precooling. An example of a Joule Thomson cryostat is shown in J. S. Buller et al., U.S. Pat. No. 3,640,091.

In the prior art, high pressure gas bottles have been used to supply refrigerant gas to a Joule Thomson cryostat, as in Wurtz U.S. Pat. No. 3,095,711, but the advantage of employing both cooling methods in combination only occurs for quick cooldown situations where the structures are close-coupled.

SUMMARY

In order to aid in the understanding of this invention it can be stated in essentially summary form that it is directed to a quick cooling cryostat which comprises a high pressure refrigerant gas supply bottle directly connected to a Joule Thomson cryostat, with means for maximizing Simon cooling, such as insulation to separate the high pressure gas in the Simon vessel from large thermal masses.

It is thus an object of this invention to provide a quick cooling cryostat which attains operating temperature more quickly, by employing Simon cooling at the input of the Joule Thomson cryostat. It is a further object to provide a Simon cooling tank which has an interior of low thermal mass, to enhance Simon cooling. It is a further object to directly couple the Simon cooler tank together with a Joule Thomson cryostat inside of the same insulation envelope. It is yet another object to provide a valve which restrains the pressure in the Simon cooling tank until cooldown is needed, and then permits Simon cooled gas to flow directly into the cryostat.

Other objects and advantages of this invention will become apparent from the study of the following portion of the specification, the claims and the attached drawings.

BRIEF DESCRIPTION OF THE DRAWINGS

FIG. 1 is a longitudinal section through a quick cooling cryostat embodying my invention.

FIG. 2 is a longitudinal section through another quick cooling cryostat embodying my invention.

FIG. 3 is an enlarged partial section, with parts broken away, through one embodiment of a valve which can be used in the quick cooling cryostat.

FIG. 4 is a longitudinal section through another such valve.

FIG. 5 is a longitudinal section through yet another such valve.

DESCRIPTION

The quick cooling cryostat of this invention is generally indicated at 10 in FIG. 1. It comprises a Joule Thomson coldfinger 12 supplied from a Simon expansion tank 14. Insulation is provided, and preferably both of them are mounted within Dewar 16.

Joule Thomson coldfinger 12 comprises a finned tube 18 wound on mandrel 20. The coiled finned tube fits within housing 22 so that out flowing exhaust gas flows among the fins on tube 18. Exhaust 24, from the warm end of the coldfinger is directed to atmosphere, which provides the lowest practical convenient exhaust pressure.

Finned tube 18 has an inlet 26 at the warmer end and an outlet 28 at the cold end. The outlet acts as a nozzle in the final Joule Thomson expansion. The cold gas expanding from the outlet nozzle 28, which may contain some liquid depending upon the refrigerant gas, temperatures, pressures and heat loads, is directed for the closest thermal communication with device 30 to be cooled. Coldfinger 12 and device 30 are protected by a suitable insulation, preferably against both radiant and conductive heat. Conventionally this comprises Dewar 16. When device 30 requires optical access, window 32, of suitable optical properties can permit the optical access. In many cases, the device 30 is an infrared sensitive device and thus window 32 and other optics are suitably transparent thereto.

Simon expansion tank 14 is a high pressure tank which contains refrigerant gas under high pressure. Its outlet is connected through valve 34 to the inlet 26 of the Joule Thomson coldfinger. When valve 34 is opened, the pressurized gas in the tank does work in expelling gas from the tank into inlet 26. In doing so the gas in tank 14 drops in temperature, in some cases to the liquifaction temperature. Success in liquifying the gas or substantially reducing its temperature to inlet 26 is dependent upon the initial pressure and temperature of the tank and the gas, the thermal mass of the tank and heat transfer characteristics of the tank. The ideal situation is a very strong tank with zero thermal mass. The thermal mass and thermal diffusivity of the tank walls are the limiting factors in the advantage gained by using the tank as a source of rapidly cooling gas into the Joule Thomson coldfinger part of the cryostat. For these reasons, insulation 36 is provided on the interior of the Simon expansion tank 14. Tank 14 can be of metallic construction, but in such case must have interior insulation for maximum advantage. However, even an uninsulated metal tank has some advantage because of the short time of the cooldown and use. One construction by which tank 14 can have a maximum strength and minimized thermal mass is by employing a wound fiberglass epoxy structure. Simon expansion tank 14 may be internally or externally mounted of Dewar 16, but the connection to the inlet 26 must be as short as possible in order to achieve maximum results and minimize the thermal mass which is subjected to the Simon expansion cooling.

Before cooling is initiated, Simon expansion tank 14 contains refrigerant gas under high pressure. Particular gases in which may be employed include Freon 14, oxygen, argon, or nitrogen. Initial pressure is in the order of 10,000 psi. Upon release of the refrigerant gas from the expansion tank through the Joule Thomson coil, and its expansion out of outlet 28, cooldown from about 300°K ambient to an operating temperature of about 100°K is achieved within less than two seconds. The volume and pressure of tank 14 and the flow rate from outlet 28 are scaled so that blowdown is completed and the end of the need for cooling occurs in about 30 seconds. With such a short blowdown time the thermal mass of the Simon expansion tank, particularly with interior insulation, does not substantially decrease the effectiveness of the Simon cooling. Even without insulation, with such a short cooling time, only the inner tank skin is cooled.

One more specific example of the invention has a 1 inch diameter spherical tank charged with argon to 10,000 psi to produce an initial flow rate of 50 standard liters per minute in a small Joule-Thomson cryostat. If the Simon effect is not utilized the cooldown time for a 75 Joule thermal mass and one watt steady state heat load with an ideal cryostat would be on the order of 2.2 seconds and the running time 15 seconds. Utilization of the Simon effect decreases the cooldown time to 1.4 seconds and extends the operating time to 30 seconds. In addition to the improvements realized in the ideal case, which are on the order of 50 percent, is the real improvement derived by lowering the temperature gradient across the Joule-Thomson cryostat heat exchanger which increases heat exchanger efficiency and provides a closer approach to ideal performance.

In FIG. 1, valve 34 can be placed between the Simon expansion tank and the coiled tube of the Joule Thomson coldfinger. In this way, the pressure is restrained in the tank. On the other hand, valve 38 can be placed at the outlet 28 of the Joule Thomson coiled tube, and with valve 34 eliminated, the pressure is restrained in the coiled tube and the expansion tank. In this way, with the start of blowdown by the opening of valve 38, the expansion of the pressurized gas within finned tube 18 first results in a Simon cooling, rather than the heating associated with compression of the gas within the tubing. Thus, a slightly smaller volume of Simon expansion tank 14 is possible for the same cooling effect, and cooldown time is reduced.

Valve 40 of FIG. 3 or valve 42 of FIG. 4 are useful in the position of valve 38. FIG. 5 illustrates the valve 34 in the line between the expansion tank and coldfinger tubing. Valve 40 comprises a plug 44 in the open end of tube 28, and sealed therein by any high pressure sealant such as solder 46. The structure is such that when mechanically actuated, plug 44 can be separated from the sealant to release the gas.

In FIG. 4, sealant 48 is electrically conductive and fusible. It contains wire 50 so that an electric pulse between wire 50 metal and tubing outlet 28 causes melting of sealant 48 with its consequent pressure blowout. The sealant 48 can be indium or lead-tin solder, in which case the wire 50 is selected to withstand high temperature. On the other hand, the sealant 48 can be an electrically conductive epoxy which is thermoset in place to provide the necessary pressure sealing. The conductive epoxy used was Epoxy Products Incorporated "E-Solder No. 3022" which has an electrical resistivity of 0.01 OHM-CH. This is approximately 600 times the resistance of eutectic lead-tin solder, and therefore is heated to a greater degree. In such a case, an electrical pulse between wire 50 and metal tube outlet 28 causes destruction of the epoxy sufficient to have the pressure blow it out. Epoxy is the preferred material.

In the valve of FIG. 5, sealant plug 52 can be the same materials as the sealant 48. Wire 54 passes through the sealant plug and is externally electrically connected through connector 56. An electrical pulse between connector 56 and metal tube 26 melts or degrades the sealant 52 to a point where it blows out.

Quick cooling cryostat 60 illustrated in FIG. 2 has the same Dewar 62 and Joule Thomson coldfinger 64. The difference is that mandrel 66 on which the finned tube 68 is wound also serves as the Simon expansion tank 70. Valve 72 or 74 is provided to control the blowdown of the Simon expansion tank through the Joule Thomson coiled tube coldfinger. The thermal mass of expansion tank 70 is large with a respect to the cooling achieved by Simon expansion, and thus interior insulation 76 minimizes the loss of the Simon cooling into the thermal mass of the Simon expansion tank. For this reason, the Simon expansion is not employed to provide heat exchange cooling through the tank walls to the Joule Thomson coldfinger coils. The result is a simpler construction when the mandrel is of sufficient volume to provide the correct amount of Joule Thomson cooling and to provide the correct volume of gas for the cooling rate and blowdown time required. The same operating materials and criteria are applicable to cryostat 60 as are applicable to cryostat 10.

This invention having been described in its preferred embodiment, is clear that it is susceptible in numerous modifications and the embodiments within the ability of those skilled in the art and without the exercise of the inventive faculty. Accordingly, the scope of this invention is defined by the scope of the following claims.

What is claimed is:

1. A cryostat comprising:

a Simon expansion tank for containing refrigerant gas under pressure, at least an interior layer in said Simon expansion tank having a lower thermal conductivity than of solid metal, outlet means from said Simon expansion tank for discharging expansion cooled gas from the interior of said Simon expansion tank for the cooling of the remaining gas in said Simon expansion tank, said outlet means also being constructed for minimizing heating of said expansion cooled gas during transfer;

a Joule Thomson coldfinger having its inlet coupled to the outlet of said Simon expansion tank to receive the expansion cooled gas by transfer from said outlet means and valve means for holding the refrigerant gas under pressure in said Simon expansion tank until cooldown and for releasing refrigerant gas from said Simon expansion tank directly through said Joule Thomson coldfinger upon opening of said valve.

2. The cryostat of claim 1 wherein said outlet means from said Simon expansion tank is a tank outlet directly connected to said inlet of said Joule Thomson coldfinger.

3. The cryostat of claim 1 wherein said Joule Thomson coldfinger has an outlet for cold refrigerant and said outlet is directed directly toward a device to be cooled.

4. The cryostat of claim 3 wherein a Dewar surrounds at least said Joule Thomson coldfinger portion of said cryostat and surrounds said device to be cooled, said Dewar having a window to permit radiation to impinge upon said device to be cooled.

5. The cryostat of claim 4 wherein said Simon expansion tank is positioned within said Dewar.

6. The cryostat of claim 5 wherein said Joule Thomson coldfinger comprises finned tubing wound around a mandrel and said mandrel comprises said Joule Thomson expansion tank.

7. The cryostat of claim 1 wherein said valve comprises a thermally degradable plug within the line of refrigerant gas flow from said Simon expansion tank, and heating means is provided for thermally degrading said plug so that refrigerant gas under pressure blows out said plug to permit refrigerant gas flow.

8. The cryostat of claim 7 wherein said thermally degradable plug is electrically conductive and is positioned within a metallic tube and said means for heating comprises an electric conductor embedded within said plug so that a current between said wire and said tube causes heating and thermal degredation of said plug.

9. The cryostat of claim 8 wherein said thermally degradable plug is made of electrically conductive epoxy.

* * * * *